US005116422A

United States Patent [19]

Tilby

[11] Patent Number: 5,116,422

[45] Date of Patent: May 26, 1992

[54] SUGARCANE SEPARATOR CONFIGURATION

[76] Inventor: Syndey E. Tilby, 4688 Boulderwood Drive, Victoria, B.C., Canada, V8Y 2P8

[21] Appl. No.: 637,500

[22] Filed: Jan. 4, 1991

[51] Int. Cl.[5] ..... B02C 9/04

[52] U.S. Cl. ..... 127/2; 241/158; 241/285.2

[58] Field of Search ..... 127/2; 241/158, 285 A

[56] References Cited

U.S. PATENT DOCUMENTS

| | | | |
|---|---|---|---|
| 605,293 | 8/1898 | Madden . | |
| 608,630 | 8/1898 | Wright . | |
| 616,177 | 12/1898 | Adelsperger . | |
| 623,753 | 3/1899 | Winchell . | |
| 623,754 | 3/1899 | Winchell . | |
| 627,886 | 6/1899 | Sherwood . | |
| 632,789 | 9/1899 | Remy . | |
| 657,341 | 9/1900 | Dyer . | |
| 670,037 | 3/1901 | Sherwood . | |
| 675,758 | 6/1901 | Sherwood . | |
| 684,492 | 10/1901 | Adamson . | |
| 707,531 | 8/1902 | Adamson . | |
| 1,689,387 | 10/1928 | Heimlich . | |
| 2,706,312 | 4/1955 | Bobkowicz | 19/7 |
| 3,424,611 | 1/1969 | Miller | 127/2 |
| 3,424,612 | 1/1969 | Miller | 127/2 |
| 3,464,877 | 9/1969 | Miller et al. | 156/259 |
| 3,464,881 | 9/1969 | Miller et al. | 161/60 |
| 3,566,944 | 3/1971 | Tilby | 146/222 |
| 3,567,510 | 12/1967 | Tilby | 99/2 ND |
| 3,567,511 | 3/1971 | Tilby | 127/43 |
| 3,690,358 | 9/1972 | Tilby | 146/119 |
| 3,698,459 | 10/1972 | Tilby | 146/119 |
| 3,721,567 | 3/1973 | Miller et al. . | |
| 3,796,809 | 3/1974 | Miller et al. | 426/2 ND |
| 3,873,033 | 3/1975 | Tilby | 241/19 |
| 3,976,498 | 8/1976 | Tilby | 127/2 |
| 3,976,499 | 8/1976 | Tilby | 127/42 |
| 4,025,278 | 5/1977 | Tilby | 425/404 |
| 4,151,004 | 4/1979 | Vukelic | 127/2 |
| 4,312,677 | 1/1982 | Tilby et al. | 127/2 |
| 4,572,741 | 2/1986 | Mason | 127/2 |
| 4,636,263 | 1/1987 | Cundiff | 127/42 |
| 4,702,423 | 10/1987 | Pinto | 241/60 |
| 4,743,307 | 5/1988 | Mason | 127/2 |
| 4,816,075 | 3/1989 | Gruenewald | 127/2 |

*Primary Examiner*—Theodore Morris
*Assistant Examiner*—P. L. Hailey
*Attorney, Agent, or Firm*—Jansson & Shupe

[57] ABSTRACT

Improved sugarcane separation equipment having movable carriages adjacent to the tower-like central unit, such carriages being movable toward and away from such central unit and having dermax removal apparatus thereon. Secondary and tertiary carriages can be included on each side of the central unit to provide additional downstream functions or earlier diversion of the product streams, as desired.

12 Claims, 3 Drawing Sheets 63
67
77
83
87
89
81
85
75
71
79
73
71
69
101
101a
107
111
109
107
105
103
121
129
123
127
125
131
113
133
91a
133
115
95
93
119
133
60
61
91
65

SUGARCANE SEPARATOR CONFIGURATION

FIELD OF THE INVENTION

This invention is related generally to processing of sugarcane, sweet sorghum and the like and, more particularly, to the separation of such plants into their constituents.

BACKGROUND OF THE INVENTION

General Background

The stalk of the sugarcane plant includes an outer rind which is a hard, wood-like fibrous substance. The rind surrounds a central core of pith, which bears nearly all of the sugar juice from which various sugar products are made. The outer surface of the rind has a thin, waxy epidermal layer, referred to herein as "dermax."

Certain other plants (e.g., sweet sorghum) are similar to sugarcane in that they are grasses having woody grass stalks. While there is frequent reference herein to sugarcane, it is to be understood that this invention applies to processing of woody grass stalks like sugarcane and sweet sorghum or certain of their constituents. At no point, including the claims, is any reference to sugarcane to be limiting.

Conventional sugarcane industry practices until today have utilized sugarcane primarily only for its sugar content. Such industry practices have involved chopping and crushing sugarcane stalks to remove the sugar juice, with the waste solids (bagasse) being used primarily only as fuel, mainly in sugar production operations.

Although such practices have been virtually uniform throughout the industry, it has been recognized that a number of very useful products may be produced from sugarcane if the sugarcane stalk is first separated into its rind, pith and dermax constituents. The many useful end-products made possible by such separation can provide great economic benefit. Such separation also provides significant efficiencies in the production of sugar.

Earlier efforts involving stalk separation, though not necessarily related to sugarcane, are reflected in the following U.S. Pat. Nos.:

605,293 (Madden)
608,630 (Wright)
616,177 (Adelsperger)
623,753 (Winchell)
623,754 (Winchell)
627,882 (Sherwood)
632,789 (Remy)
657,341 (Dyer)
670,037 (Sherwood)
675,758 (Sherwood)
684,492 (Adamson)
707,531 (Adamson)
1,689,387 (Heimlich)
2,706,312 (Bobkowicz).

Even though stalk separation efforts began as early as the late 1800's, essentially the entire sugarcane industry continued in the conventional process noted above, involving chopping and crushing of the whole stalk to extract sugar juice.

Technology in this field remained rather dormant until the 1960's, when a resurgence of development activity began, substantially all related to what has been known in the industry as the Tilby system, a cane separation system named after the principal originator, Sydney E. ("Ted") Tilby.

Broadly speaking, the Tilby system includes a multistep operation executed by various portions of a cane separator machine. Sugarcane billets, i.e., cut lengths of cane stalk preferably about 25–35 cm long, are driven downwardly over a splitter to divide them lengthwise into semi-cylindrical half-billets. The two half-billets of a split billet are then processed individually by symmetrical downstream portions of the separator machine.

The first of such downstream portions of the separator is a depithing station which includes a cutter roll and holdback roll for milling pith away from the rind of the half-billet while simultaneously flattening the rind. The next downstream portion is a dermax removal station from which the rind emerges ready for subsequent processing in a variety of ways, including slitting, chipping and/or many other processing steps. The pith is conveyed away from the separator machine to an extraction station where its sugar juice is removed.

A significant number of patents related to the Tilby system and improvements in such system have been granted, beginning in the 1960's. These and other fairly recent United States patents related generally to sugarcane processing are as follows: U.S. Pat. Nos.

3,424,611 (Miller)
3,424,612 (Miller)
3,464,877 (Miller et al.)
3,464,881 (Miller et al.)
3,566,944 (Tilby)
3,567,510 (Tilby)
3,567,511 (Tilby)
3,690,358 (Tilby)
3,698,459 (Tilby)
3,721,567 (Miller et al.)
3,796,809 (Miller et al.)
3,873,033 (Tilby)
3,976,498 (Tilby)
3,976,499 (Tilby)
4,025,278 (Tilby)
4,151,004 (Vukelic)
4,312,677 (Tilby et al.)
4,572,741 (Mason)
4,636,263 (Cundiff)
4,702,423 (Pinto)
4,743,307 (Mason)
4,816,075 (Gruenewald).

The Tilby system, when finally fully commercialized, can provide substantial outputs of several high-value products. This greatly increases cash yields per ton of sugarcane, a factor of significant importance to an industry in which profitability in recent years has been marginal at best. This is important generally, but is of particular importance to the many developing countries in which a flourishing sugarcane industry would be a boon to economic growth and stability.

Considering that sugarcane is one of the most rapidly growing, easily developed, and readily accessible sources of biomass, full commercialization of the Tilby system can significantly reduce dependence on forests and on certain other crops and resources. Among the products which can be made from sugarcane constituents separated by the Tilby system are sugar in an increased variety of forms, foods and food additives, animal feeds, a variety of wood products and building materials, alcohol for a variety of purposes, paper and other pulp-containing products, and a variety of specialty products.

While substantial technical development has occurred over a period of many years with respect to the Tilby system, a number of difficult and critical problems have remained. The failure to overcome such problems has prevented full commercialization of the Tilby system. The invention described and claimed herein is directed to the solution of certain of these problems.

Specific Background

Certain problems relate to inaccessibility to critical portions of the sugarcane separation apparatus for adjustment, part replacement and other servicing. Other problems relate to significant difficulties in changing the separation apparatus to allow production of various alternative products.

These problems can best be understood by reference to certain prior sugarcane separation apparatus, including that disclosed in U.S. Pat. Nos. 3,567,510 (Tilby) and 3,976,498 (Tilby et al.). The apparatus shown in such patents performs such functions using an upstanding, tower-like central unit shaped like an inverted "Y." The tower-like central unit is symmetrical in a "mirror image" arrangement having fold-out wings to permit access to the interior. Such unit is rail-mounted to allow it to be shunted aside for service.

Such tower-like central unit receives billets which are forced downwardly end-first onto a knife by a pair of feed rolls, thereby splitting the billets longitudinally into half billets. The half billets, with the interior pith now exposed, are fed through two depithing sections, one at either side of the unit. Such central unit also includes a dermax removal section immediately beyond each of the depithing sections, so that the central unit is crowded with separation sections. Such crowding causes a variety of operational problems and makes the unit difficult to service.

While these prior systems have significant utility, they have not fully addressed the need for highly flexible, highly reliable, easily serviceable cane separating and processing apparatus with high throughput providing separated sugarcane constituents in a variety of forms for use in a variety of cane products. An improved sugarcane separator configuration which is responsive to such needs would be an important advance in the art.

OBJECTS OF THE INVENTION

It is an object of this invention to provide an improved separator configuration overcoming some of the problems and shortcomings of the prior art.

Another object of this invention is to provide an improved separator configuration suitable for use in a continuous operation.

Another object of this invention is to provide an improved separator configuration having a high-throughput capability.

Yet another object of this invention is to provide an improved separator configuration which is highly reliable.

Still another object of this invention is to provide an improved separator configuration providing easier adjustment, part replacement and other servicing.

Another object of this invention is to provide an improved separator configuration wherein the configuration of the separator apparatus may be easily changed to allow production of various alternative products.

These and other important objects will be apparent from the descriptions of this invention which follow.

SUMMARY OF THE INVENTION

The invention is an improvement in an apparatus for sugarcane separation of the type having means to split sugarcane billets, means for removing pith from the rinds of split billets, and means for removing dermax from such rinds. As in the prior art, the apparatus includes a tower-like central unit with a pair of wings. But the arrangement of the functional parts of the unit and of related equipment differs substantially from the arrangements of the prior art.

More specifically, the invention includes a primary carriage adjacent to the central unit. Rather than having the dermax-removing means mounted on the central unit, it is mounted on such primary carriage and is thereby movable into and out of a rind-receiving relationship with respect to one of the wings of the central unit.

A secondary carriage is movable into and out of a rind-receiving relationship with respect to the primary carriage. The secondary carriage may have any of several secondary downstream rind-processing means mounted thereon. However, in a highly preferred embodiment, the secondary downstream rind-processing means includes means for slitting the rind longitudinally.

The apparatus also includes a tertiary carriage movable into and out of a rind-receiving relationship with respect to the secondary carriage. Such tertiary carriage has a tertiary downstream rind-processing means mounted thereon. Preferably such rind-processing means includes means for cutting rind pieces across the grain.

The secondary carriage is supported by and movable on the primary carriage in what may be described as a "piggy back" arrangement. Because of such arrangement, the primary and secondary carriages are movable in relative fixed positions (with respect to one another) by movement of the primary carriage.

More specifically, the primary carriage has an upstream end bearing the dermax-removing means thereon and a lower supporting portion such as a frame which bears the secondary carriage and which extends away from the central unit and the upstream end of the primary carriage. The direction of extension is along the line of carriage movability and the lower supporting portion extends to a distance exceeding the length of the secondary carriage.

Similarly, the tertiary carriage is supported by and movable on the secondary carriage. When so arranged, such secondary and tertiary carriages are movable in relative fixed positions by movement of the secondary carriage and such primary, secondary and tertiary carriages are movable in relative fixed positions by movement of the primary carriage.

The secondary carriage has an upstream end which bears the secondary downstream rind-processing means on it. A secondary lower supporting portion bears the tertiary carriage and extends away from the central unit and away from the upstream end of the secondary carriage. The direction of such extension is along the line of carriage movability and such lower supporting portion extends by a distance exceeding the length of the tertiary carriage.

It is now apparent that when the carriages are arranged as described, the primary, secondary and tertiary carriages are movable in relative fixed positions to one another by moving the primary carriage. Further, the secondary and tertiary carriages are movable in relative fixed positions to one another by moving the secondary carriage. And of course, the tertiary carriage is separately movable by itself. It is to be appreciated from the foregoing that a primary carriage, primary and secondary carriages or primary, secondary and tertiary carriages may also be used with the other wing of the central unit.

Such arrangement offers great flexibility. If the producer wishes to obtain cut rind pieces, all three carriages are used with the central unit. If longitudinally slit rind is needed, the secondary and tertiary carriages are not then in use and may be spaced apart to allow diversion of rind flow away from the apparatus at a point upstream of the tertiary carriage. And if the producer needs only rind from which dermax has been removed, the secondary and tertiary carriages (which are not then in use) may be spaced apart from the primary carriage to allow such diversion of rind at a point upstream of the secondary carriage. If depithed rind is required, none of the three carriages are in use and all may be spaced apart from the central unit.

Another significant advantage of the improved separator configuration is that the carriages (or any combination of them) can be moved with respect to one another or with respect to the central unit to gain quick access to most areas for service purposes. This is an important benefit when one considers that downtime of such separator equipment and consequent loss of production is very expensive.

DETAILED DESCRIPTIONS OF PREFERRED EMBODIMENTS

The inventive arrangement 60 is an improvement in an apparatus for sugarcane separation of the type having means to split sugarcane billets, means for removing pith from the rinds of split billets and means for removing dermax from such rinds.

Figure 1:
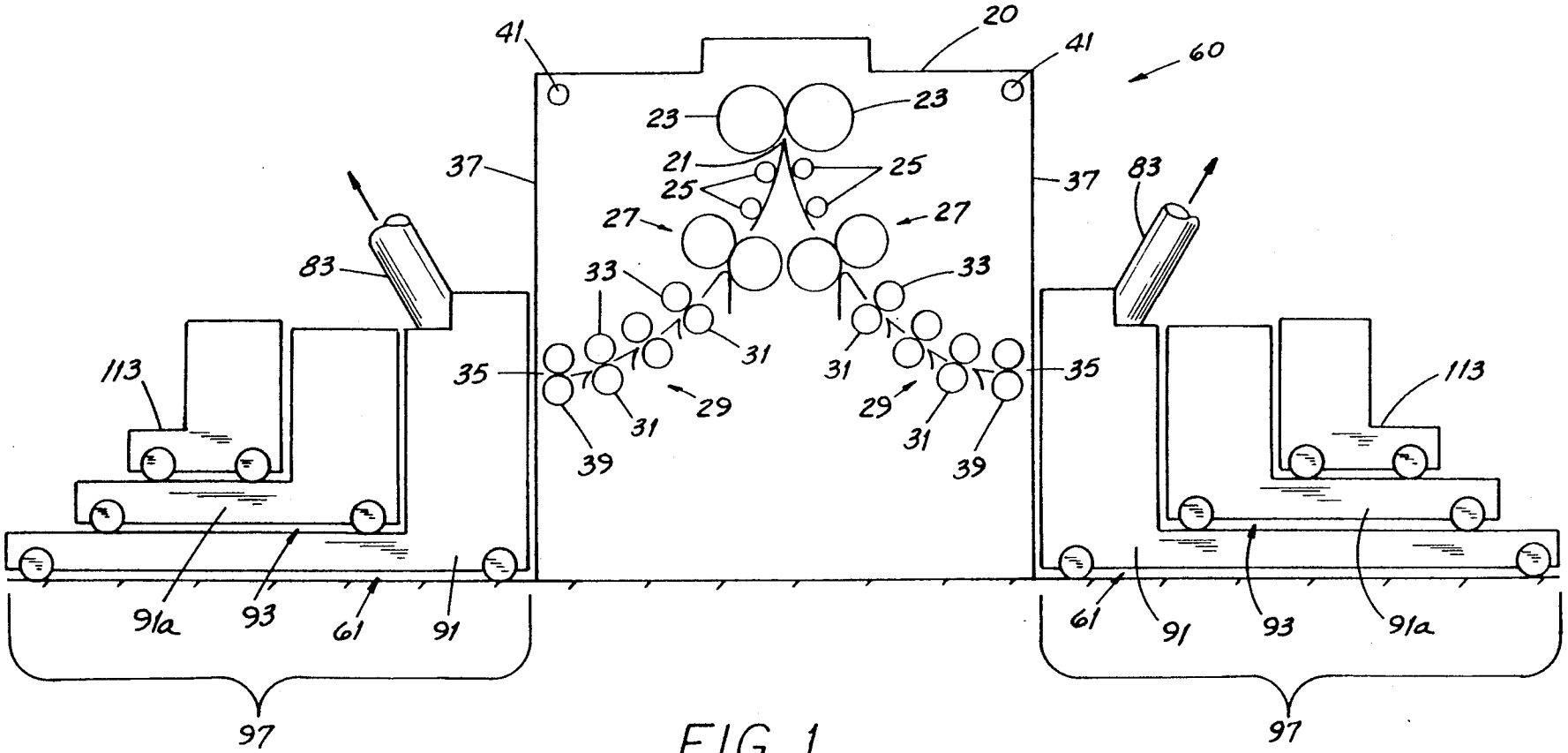
FIG. 1 is a front elevation view of the improved arrangement including a tower-like central unit of a known type and further including primary, secondary and tertiary carriages.

The invention includes a tower-like central unit 20, illustrated in FIG. 1, which is symmetrical in a "mirror-image" arrangement. This unit 20 receives billets which are forced downwardly end-first onto a knife 21 by a pair of feed rolls 23, thereby splitting the billets longitudinally into half billets. The half billets, with the interior pith now exposed, are guided by rotating control brushes 25 into two depithing sections 27, one at either side of the unit 20. Each of such sections 27 is followed by three dual-roll sets 29 arranged in sequence, each such set 29 including a brush roll 31 and a feed roll 33. The secondary flow of pith from a depithing section 27 is captured by the dual-roll sets 29 and diverted to the pith collection area. The fully depithed rind is then ejected from a port 35 at each wing 37 of the unit 20 by a pair of rubber-clad grasping rolls 39. For service, each wing 37 may be pivoted upward about a pivot pin 41 for easy access to the interior of the unit 20.

Figure 2:
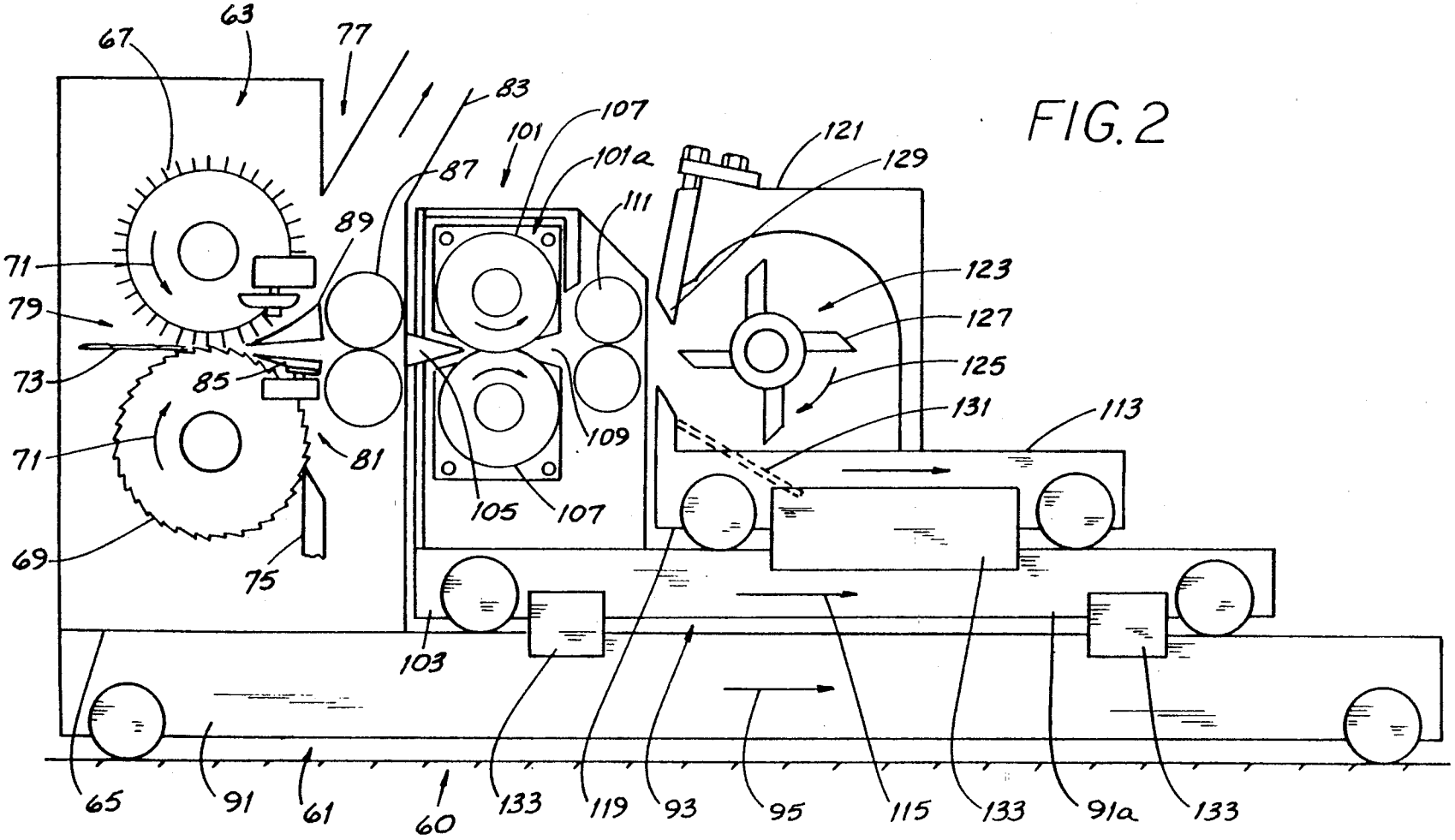
FIG. 2 is an enlarged front elevation view of the primary, secondary and tertiary carriages of FIG. 1.

Referring also to FIG. 2, the improvement comprises a primary carriage 61 adjacent to the central unit 20. Such primary carriage 61 is movable into and out of a rind-receiving relationship with respect to one of the wings 37 and receives depithed rind ejected from the port 35 on the central unit 20. Preferably, such primary carriage 61 has the dermax-removing means 63 mounted on it rather than on the central unit 20.

The dermax-removing means 63, mounted at the upstream end 65 of the carriage 61, includes a dermax milling drum 67 and a holdback roll 69 which counter-revolve in the directions of the arrows 71 and coact for dermax removal. As the rind 73 enters the "nip" between the drum 67 and the roll 71, the roll 71 retards the progress of the rind 73 as the drum 67 mills dermax from its outer surface. While the rind 73 passing into the nip is essentially free of pith, small amounts remain. Therefore, a cleaning blade 75 is positioned adjacent the roll 71 for removing such small amounts of pith.

Separated dermax is conveyed from the removal site by a vacuum conveyer 77. Air entering the paths 79 and 81 carries dermax with it and the air stream (with entrained dermax) flows up the tube 83.

A slide 85 is provided adjacent the holdback roll 69 for guiding rind 73 into the nip defined by the feedrolls 87. Proper regulation of the negative vacuum pressure in the tube 83 also helps guide the rind 73 into such nip. However, a deflector 89 may also be added if desired. As is now apparent from the foregoing, the output product of the preferred primary carriage 61 is rind 73 from which pith has been removed by the central unit 20 and from which dermax has been removed on the carriage 61.

Figure 5:
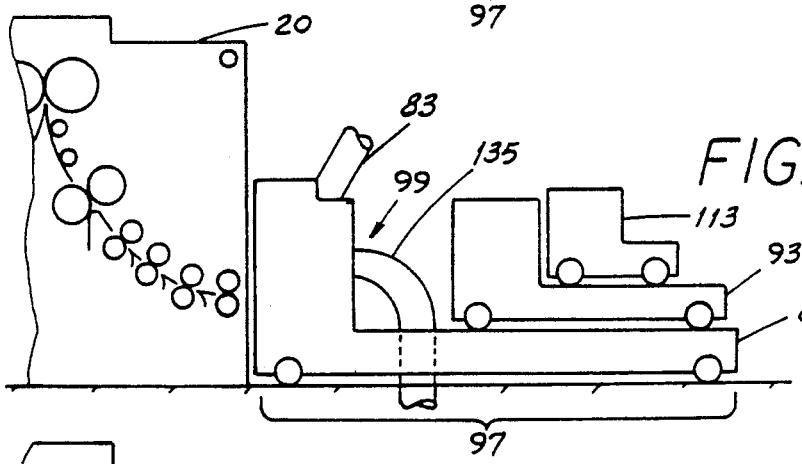
FIG. 5 is a front elevation view similar to that of FIG. 1 but with a portion of the central unit broken away and with the secondary and tertiary carriages spaced from the primary carriage for diversion of rind flowing from the primary carriage.

The primary carriage 61 also includes a lower supporting portion 91 which bears the secondary carriage 93. Such portion 91 extends generally horizontally away from the central unit 20 and the upstream end 65 and along the line of carriage movability 95. The distance at which such portion 91 extends along the line 95 exceeds the length of the secondary carriage 93. As further described below, this permits the primary carriage 61 and the secondary carriage 93 to be spaced apart to allow diversion away from the apparatus 97 of rind 73 flowing out of the feed rolls 87. As shown in FIG. 5, such diversion is at a point 99 upstream of the secondary carriage 93.

Similarly, the secondary carriage 93 is movable into and out of a rind-receiving relationship with respect to the primary carriage 61. Such secondary carriage 93 may have any of several secondary downstream rind-processing means mounted thereon. However, in a highly preferred embodiment, the secondary downstream rind-processing means 101 includes means **101*a*** at the upstream end 103 for slitting the rind longitudinally.

Such slitting means includes a receiving mouth 105 for directing rind 73 into the enmeshed, counter-revolving slitter rolls 107 where the rind 73 is longitudinally separated in the direction of the grain by shearing to form long, thin strips of rind 73. The exit mouth 109 guides such strips into feedrolls 111 for diversion of the flow of strips away from the apparatus 97 or for directing the strips to the tertiary carriage 113, as required. Further explanation is set out below.

Figure 4:
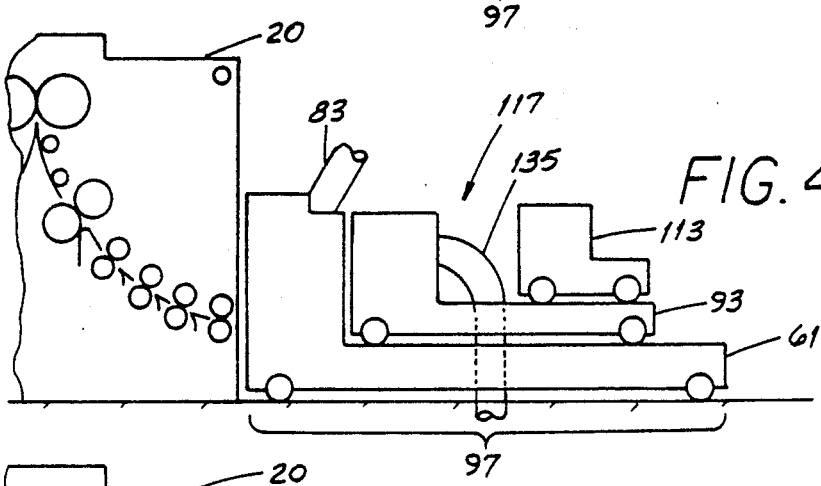
FIG. 4 is a front elevation view similar to that of FIG. 1 but with a portion of the central unit broken away and with the tertiary carriage spaced from the secondary and primary carriages for diversion of rind flowing from the secondary carriage.

The secondary carriage 93 also includes a lower supporting portion 91*a* which bears the tertiary carriage 113. Such portion 91*a* extends generally horizontally away from the central unit 20 and the upstream end 103 and along the line of carriage movability 115. The distance at which such portion 91*a* extends along such line 115 exceeds the length of tertiary carriage 113. As further described below, this permits secondary carriage 93 and tertiary carriage 113 to be spaced apart to allow diversion of rind 73 away from apparatus 97 as it exits feed rolls 111. As shown in FIG. 4, such diversion is at a point 117 upstream of tertiary carriage 113.

Tertiary carriage 113 is movable into and out of a rind-receiving relationship with respect to secondary carriage 93. At its upstream end 119, tertiary carriage 113 has a tertiary downstream rind-processing means 121 mounted thereon. Any of several rind-processing means 121 may be used, but in the preferred embodiment such means cuts rind strips across the grain.

Rind-processing means 121 includes a housing and within the housing an impeller wheel 123 which is driven for rotation in the direction shown by arrow 125. Impeller wheel 123 has a plurality of blades 127 which direct the rind strips toward a sharpened anvil 129 where they are cut across the grain into small segments (chips) by the cooperative action of blades 127 and anvil 129. Impeller wheel 123 and its housing act as a blower to throw the chips to a conveyor below (not shown). A chute or apron 131 may be used to help direct the flow of chips toward such conveyor.

As is now apparent from the foregoing, the secondary carriage 93 is supported by and movable on the primary carriage 61 in what may be described as a "piggy-back" arrangement. Because of such arrangement, the primary and secondary carriages 61 and 93 are movable in relative fixed positions with respect to one another by movement of the primary carriage 61. Further, tertiary carriage 113 is supported by and movable on secondary carriage 93 in a similar piggy-back arrangement. Thus, carriages 93 and 113 are movable in relative fixed positions with respect to each other by secondary carriage movement. And primary, secondary and tertiary carriages 61, 93 and 113 may be moved in relative fixed positions by moving only the primary carriage 61; the tertiary carriage 113 is also movable alone. Retainer clips 133 keep the carriages 61, 93, 113 from separating vertically. It is to be appreciated from the foregoing that a primary carriage 61, primary and secondary carriages 61, 93 or primary, secondary and tertiary carriages 61, 93, 113 may also be used with the leftward wing 37 of the central unit 20.

Figure 3:
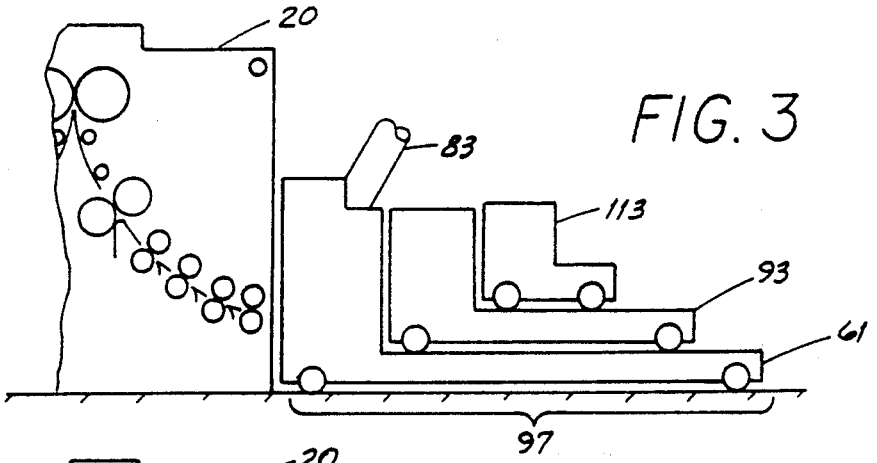
FIG. 3 is a front elevation view similar to that of FIG. 1 but with a portion of the central unit broken away and with all carriages positioned to sequentially process the output product of the central unit.

Such arrangement 60 offers great production flexibility. If the producer wishes to obtain cut rind segments or pieces, all three carriages 61, 93, 113 are used with the central unit 20 as shown in FIG. 3. If rind strips are needed, the tertiary carriage 113 is not then in use and may be spaced apart from the secondary carriage 93 as shown in FIG. 4. This allows attachment of a chute 135 to divert rind flow away from the apparatus 97 at a point 117 upstream of the tertiary carriage 113. And if the producer needs only rind 73 from which dermax has been removed but which has not yet been slit, FIG. 5 shows how the secondary and tertiary carriages 93, 113 (which are not then in use) may be spaced apart from the primary carriage 61. This allows attachment of the chute 135 and diversion of rind 73 at a point 99 upstream of the secondary carriage 93. If depithed rind is required, none of the three carriages 61, 93, 113 are in use and all may be spaced apart from the central unit 20.

Figure 6:
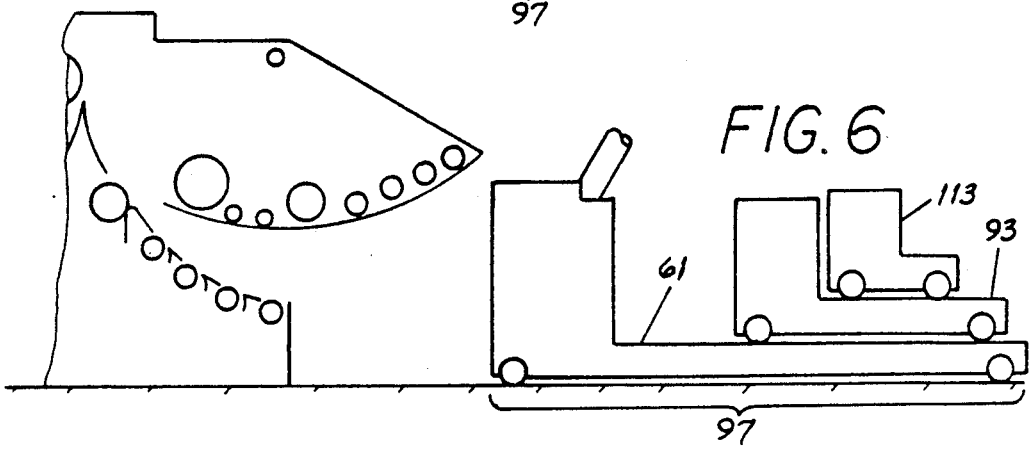
FIG. 6 is a front elevation view similar to that of FIG. 1 but with a portion of the central unit broken away, with all carriages spaced from the central unit and with a wing of the central unit open for service.

Another significant advantage of the improved arrangement 60 is that the carriages 61, 93, 113 (or any combination of them) can be moved with respect to one another or with respect to the central unit 20 to gain quick access to any area for service purposes. FIG. 6 shows how the carriages 61, 93, 113 may be moved away from the central unit 20 and the wing 37 opened for servicing such unit 20. This is an important benefit when one considers that downtime of such separator equipment and consequent loss of production is very expensive.

While the principles of this invention have been described in connection with specific embodiments, it should be understood clearly that these descriptions are made only by way of example and are not intended to limit the scope of the invention.

I claim:

1. In an apparatus for sugarcane separation of the type having means to split sugarcane billets, means for removing pith from the rinds of split billets, and means for removing dermax from such rinds, such apparatus including a central unit with a pair of upwardly pivotable wings on either side thereof, the improvement comprising a primary carriage adjacent to the central unit and movable into and out of a rind-receiving relationship with one of the wings, such primary carriage having the dermax-removing means thereon for receiving depithed rind from the central unit.

2. The apparatus of claim 1 having another primary carriage movable into and out of a rind-receiving relationship with the other wing of such central unit.

3. The apparatus of claim 1 having a secondary carriage movable into and out of a rind-receiving relationship with the primary carriage, the secondary carriage having a secondary downstream rind-processing means mounted thereon.

4. The apparatus of claim 3 wherein the secondary downstream rind-processing means is means for slitting the rind longitudinally.

5. The apparatus of claim 3 wherein such secondary carriage is supported by and movable on the primary carriage, whereby such primary and secondary carriages are movable in relative fixed positions by movement of the primary carriage.

6. The apparatus of claim 5 wherein the primary carriage has an upstream end bearing the dermax-removing means thereon and a lower supporting portion bearing the secondary carriage and extending away from the central unit and the upstream end of the primary carriage along the line of carriage movability by a distance exceeding the length of the secondary carriage, whereby the primary and secondary carriages may be spaced apart to allow diversion of rind flow away from the apparatus at a point upstream of the secondary carriage.

7. The apparatus of claim 6 wherein the secondary downstream rind-processing means is means for slitting the rind longitudinally.

8. The apparatus of claim 3 having a tertiary carriage movable into and out of a rind-receiving relationship with the secondary carriage, the tertiary carriage having a tertiary downstream rind-processing means mounted thereon.

9. The apparatus of claim 8 wherein:

the secondary downstream rind-processing means is means for slitting the rind longitudinally; and the tertiary downstream rind-processing means is a means for cutting rind pieces across the grain.

10. The apparatus of claim 8 wherein such tertiary carriage is supported by and movable on the secondary carriage, whereby such secondary and tertiary carriages are movable in relative fixed positions by movement of the secondary carriage and such primary, secondary and tertiary carriages are movable in relative fixed positions by movement of the primary carriage.

11. The apparatus of claim 10 wherein:

the primary carriage has an upstream end bearing the dermax-removing means thereon and a primary lower supporting portion bearing the secondary carriage and extending away from the central unit and the upstream end of the primary carriage along the line of carriage movability by a distance exceeding the length of the secondary carriage; and the secondary carriage has an upstream end bearing the secondary downstream rind-processing means thereon and a secondary lower supporting portion bearing the tertiary carriage and extending away from the central unit and the upstream end of the secondary carriage along the line of carriage movability by a distance exceeding the length of the tertiary carriage, whereby if the tertiary or secondary and tertiary downstream rind-processing units are not in use the secondary and tertiary carriages or the primary and secondary carriages may be spaced apart to allow diversion of rind flow away from the apparatus at a point either between the secondary and tertiary carriages or between the primary and secondary carriages.

12. The apparatus of claim 11 wherein:

the secondary downstream rind-processing means is means for slitting the rind longitudinally; and the tertiary downstream rind-processing means is a means for cutting rind pieces across its grain.

* * * * *